US008602038B2

(12) United States Patent
Choi

(10) Patent No.: US 8,602,038 B2
(45) Date of Patent: Dec. 10, 2013

(54) HAIRSTYLING BRUSH IRON

(76) Inventor: Myung Pyo Choi, Gyeonggi-do (KR)

( * ) Notice: Subject to any disclaimer, the term of this patent is extended or adjusted under 35 U.S.C. 154(b) by 0 days.

(21) Appl. No.: 13/202,134

(22) PCT Filed: Dec. 23, 2010

(86) PCT No.: PCT/KR2010/009248

§ 371 (c)(1),
(2), (4) Date: Aug. 18, 2011

(87) PCT Pub. No.: WO2011/078593

PCT Pub. Date: Jun. 30, 2011

(65) Prior Publication Data

US 2012/0247501 A1 Oct. 4, 2012

(30) Foreign Application Priority Data

Dec. 24, 2009 (KR) ..... 10-2009-0130430
Dec. 22, 2010 (KR) ..... 10-2010-0132705

(51) Int. Cl.

| | |
|---|---|
| ***A45D 24/04*** | (2006.01) |
| ***A45D 20/08*** | (2006.01) |
| ***A45D 24/10*** | (2006.01) |
| ***A45D 24/16*** | (2006.01) |
| ***A45D 1/02*** | (2006.01) |
| ***A45D 2/22*** | (2006.01) |
| ***A45D 1/00*** | (2006.01) |

(52) U.S. Cl.
USPC ..... 132/271; 132/152; 132/118; 132/120; 132/227; 132/269

(58) Field of Classification Search
USPC ..... 132/152, 210, 211, 212, 219, 118, 120, 132/141, 142, 151, 223, 226, 227, 228, 229, 132/240, 241, 243, 269, 271, 155, 103, 901, 132/111, 112, 143; 219/222, 223, 225, 226, 219/227, 228, 229; 34/96, 283; 392/379, 392/380, 383, 384; 119/600, 606, 663, 664
See application file for complete search history.

(56) References Cited

U.S. PATENT DOCUMENTS 1,305,226 A * 5/1919 Kunkler ..... 132/152
2,598,330 A * 5/1952 Wilson ..... 132/117

(Continued)

FOREIGN PATENT DOCUMENTS

KR 20-0402222 Y1 11/2005
KR 20-0429529 Y1 10/2006

(Continued)

OTHER PUBLICATIONS

International Search Report mailed Sep. 29, 2011 for PCT/KR2010/009248.

(Continued)

*Primary Examiner* — Vanitha Elgart

(57) ABSTRACT

The present invention relates to a hairstyling brush iron which applies heat to the hair of a user to set a desired hair style, and which can protect the scalp of the user from heat. The hairstyling brush iron according to one embodiment of the present invention comprises; an iron roll which is heated up to a high temperature, and the outer surface of which has a plurality of grooves formed in a lengthwise direction thereof; and a brush which is coupled to the iron roll by coupling a lower portion thereof to the grooves of the iron roll.

18 Claims, 6 Drawing Sheets

(56) References Cited

U.S. PATENT DOCUMENTS

| | | | | | |
|---|---|---|---|---|---|
| 3,962,742 | A | * | 6/1976 | Vendur | 15/201 |
| 3,973,528 | A | * | 8/1976 | Walter et al. | 132/120 |
| 4,032,747 | A | * | 6/1977 | Kunz | 219/222 |
| 4,126,143 | A | * | 11/1978 | Schroeder | 132/118 |
| 4,217,915 | A | * | 8/1980 | Gress et al. | 132/271 |
| 4,250,902 | A | * | 2/1981 | Ihara | 132/271 |
| 4,267,851 | A | * | 5/1981 | Plaisted | 132/229 |
| 4,292,986 | A | * | 10/1981 | Ergaver et al. | 132/118 |
| 4,368,376 | A | | 1/1983 | Andis | |
| 4,496,825 | A | | 1/1985 | Andis | |
| D281,728 | S | * | 12/1985 | Sherman | D28/35 |
| 4,593,708 | A | * | 6/1986 | Goeller et al. | 132/212 |
| 4,623,779 | A | * | 11/1986 | Raab | 219/222 |
| 4,641,010 | A | * | 2/1987 | Abura et al. | 219/222 |
| 4,695,704 | A | * | 9/1987 | Andis | 219/222 |
| 5,673,710 | A | * | 10/1997 | Schaefer et al. | 132/118 |
| 6,070,596 | A | * | 6/2000 | Altamore | 132/224 |
| 6,618,893 | B1 | * | 9/2003 | Wang | 15/186 |
| D650,942 | S | * | 12/2011 | Choi | D28/35 |
| 2004/0129288 | A1 | * | 7/2004 | Saida et al. | 132/228 |
| 2011/0017226 | A1 | * | 1/2011 | Choi | 132/120 |

FOREIGN PATENT DOCUMENTS

| | | | |
|---|---|---|---|
| KR | 10-2007-0100436 | A | 10/2007 |
| KR | 10-2008-0097234 | A | 11/2008 |

OTHER PUBLICATIONS

Written Opinion of the International Search Report mailed Sep. 29, 2011 for PCT/KR2010/009248.

* cited by examiner

HAIRSTYLING BRUSH IRON

This application claims the priority of Korean Patent Application No. 10-2009-0130430, filed on Dec. 24, 2009 and priority of Korean Patent Application No. 10-2010-0132705, filed on Dec. 22, 2010, in the KIPO (Korean Intellectual Property Office), the disclosure of which is incorporated herein entirely by reference. Further, this application is the National Stage application of International Application No. PCT/KR2010/009248, filed Dec. 23, 2010, which designates the United States and was published in Korean. Each of these applications is hereby incorporated by reference in their entirety into the present application.

TECHNICAL FIELD

The present invention relates to a hairstyling brush iron.

BACKGROUND ART

In general, when people, particularly women, design their desired hair styles by trimming strands of hair, the desired hair style is first set with a comb such as a roll brush and then fixed using heat applied from a hairdryer. In the conventional hair styling method, however, the comb and the hairdryer need to be used at the same time, which is cumbersome and inconvenient in use. In addition, a force should be applied to the strands of hair using the comb and the hairdryer in order to transform the strands of hair in a desired manner, which is a laborious work for a user. Further, hair professionals, such as hairdressers, perform such a laborious work repeatedly for a long time, which is quite an exhausting work.

DISCLOSURE OF INVENTION

Technical Problem

An embodiment of the present invention provides a hairstyling brush iron which can set a user's desired hair style by applying heat to strands of hair and can protect the user's scalp against the heat.

Technical Solution

According to an embodiment of the present invention, a hairstyling brush iron is provided, including an iron roll heated up to a high temperature, the iron roll hawing a plurality of grooves formed in a lengthwise direction along an outer surface of the iron roll, and a plurality of brushes coupled to the iron roll by coupling lower portions of the brushes to the grooves of the iron roll, wherein the brushes include one or more heat transfer units, the one or more heat transfer units have hollow holes formed in a vertical direction and coupled to the grooves of the iron roll, and one or more heat shield units coupled to the hollow holes and exposed through upper portions of the one or more heat transfer units.

Each of the one or more heat transfer units may be formed of a metal material.

Each of the one or more heat transfer units may be formed such that a diameter of its lower portion is greater than that of its upper portion so as to allow the lower portion to be coupled to each of the grooves.

The one or more heat transfer units include a plurality of heat transfer units of the same shape and protrude in the direction in which the lower portions thereof are coupled to the grooves so that adjacent ones of the plurality of heat transfer units are spaced apart from each other.

Each of the one or more heat shield units may be formed of a plastic material.

The one or more heat shield units may include as many heat shield units as the heat transfer units and have heights greater than those of the one or more heat transfer units so that they protrude further than top portions of the heat transfer units.

The one or more heat shield units may be formed as discrete units coupled to the hollow holes of the one or more heat transfer units respectively and may protrude further than top portions of the heat transfer units.

Each of the brushes may further include a protection unit formed in at least one of front and rear ends of the heat transfer unit using the same material as the heat shield unit.

The hairstyling brush iron may further include heater provided within the iron roll to apply heat to the iron roll.

The iron roll may be cylindrical shape and the grooves are formed in a lengthwise direction of its lateral surface.

The iron roll may be substantially plate-shaped and the grooves are formed in a lengthwise direction of its top surface.

According to another embodiment of the present invention, a hairstyling brush iron is provided, including an iron roll heated up to a high temperature, the iron roll having a plurality of grooves formed in a lengthwise along an outer surface of the iron roll; and a plurality of brushes coupled to the iron roll by coupling lower portions of the brushes to the grooves of the iron roll, wherein each of the brushes is formed of a plastic material and has diameter of its lower portion greater than that of its upper portion so that the lower portion is coupled to each of the grooves and the upper portion is exposed through an upper portion of the iron roll.

The brushes may be integrally formed in an array of rows and the brushes in each row may be coupled to the grooves of the iron roll.

The brushes may have lower portions integrally formed in each row.

The brushes may be formed in each row such that upper portions of adjacent brushes protruding from the iron roll are spaced apart from each other.

The brushes may include a plurality of discrete brushes separated from each other and coupled to the grooves of the iron roll.

The iron roll may be cylindrical shape and the grooves are formed in a lengthwise direction of its lateral surface.

The iron roll may be substantially plate-shaped and the grooves are formed in a lengthwise direction of its top surface.

Advantageous Effects

As described above, the hairstyling brush iron according to the present invention includes grooves formed in a lengthwise on the lateral surface of an iron roll and heat transfer units coupled to the grooves to allow the heat transfer units to contact user's hair, thereby facilitating hair style setting.

In addition, the hairstyling brush iron according to the present invention includes heat shield units formed in the heat transfer units and further protruding than the heat transfer units, to allow the heat shield units to contact user's scalp, thereby protecting the user's scalp from the heat transfer units of high temperature.

Further, the hairstyling brush iron according to the present invention includes brushes integrally formed by row to allow the brushes to be combined with the grooves of the iron roll all at once, thereby increasing the productivity.

BEST MODE FOR CARRYING OUT THE INVENTION

Hereinafter, embodiments of the present invention will be described in detail with reference to the accompanying drawings so that those skilled in the art to which the present invention pertains can realize the present invention.

A configuration of a hairstyling brush iron according to an embodiment of the present invention will now be described.

Figure 1:
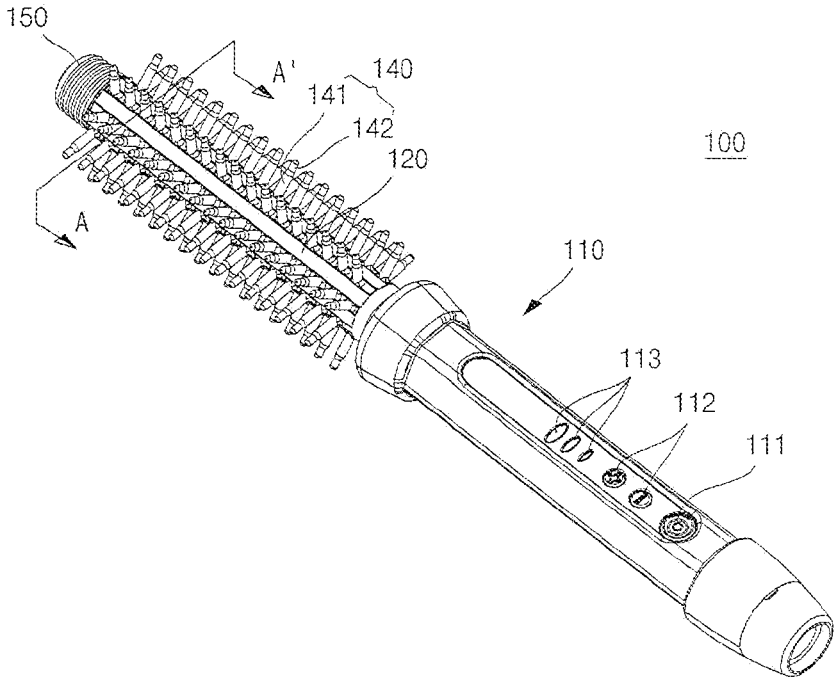
FIG. 1 is a perspective view of a hairstyling brush iron according to an embodiment of the present invention.
Figure 2:
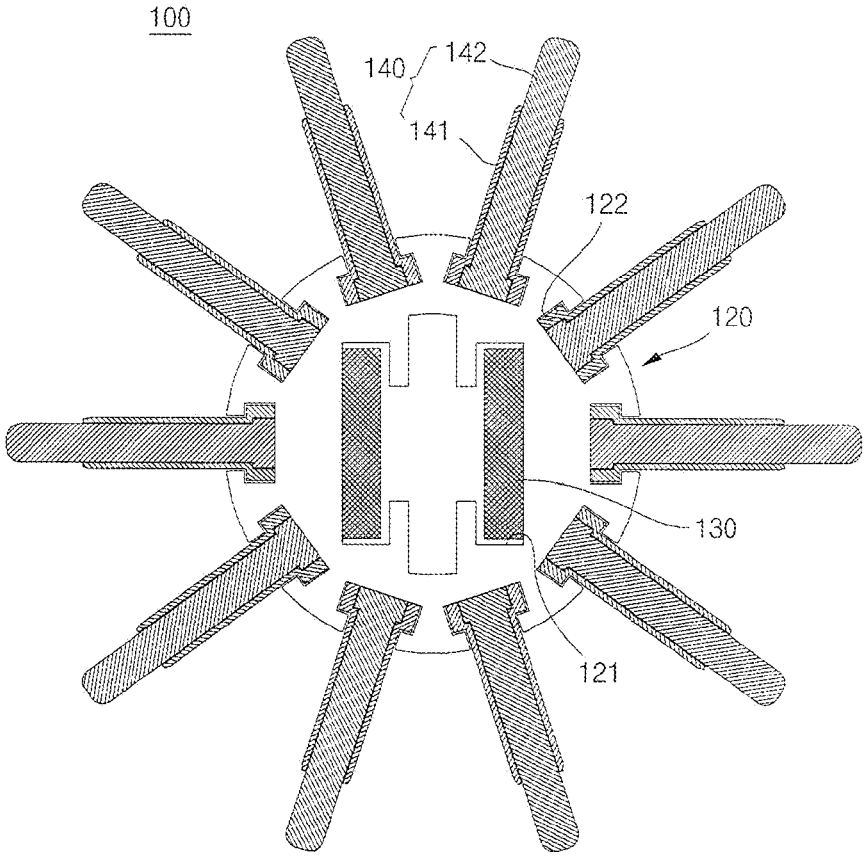
FIG. 2 is a cross-sectional view of the line A-A' of FIG. 1.
Figure 3:
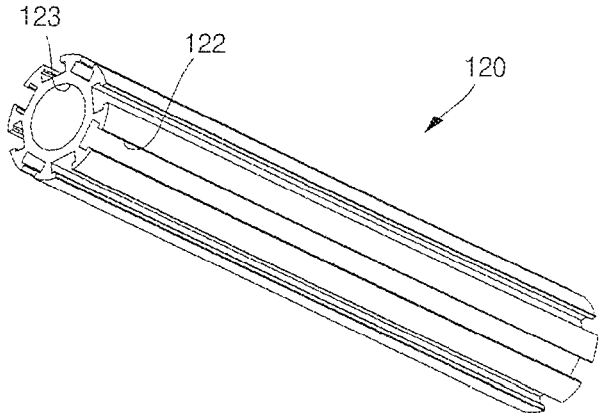
FIG. 3 is a perspective view of an iron roll of the hairstyling brush iron according to an embodiment of the present invention.
Figure 4:
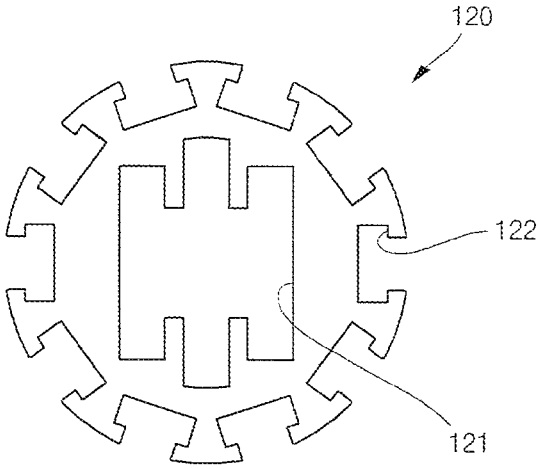
FIG. 4 is a cross-sectional view of the iron roll of the hairstyling brush iron according to an embodiment of the present invention.
Figure 5:
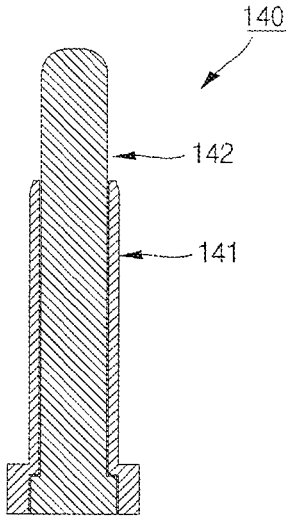
FIG. 5 is a cross-sectional view illustrating a brush of the hairstyling brush iron according to an embodiment of the present invention.
Figure 6:
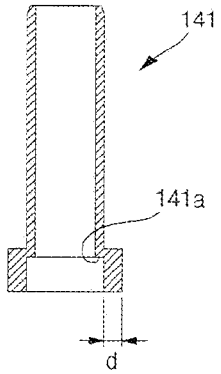
FIG. 6 is a cross-sectional view illustrating a heat transfer unit of the hairstyling brush iron according to an embodiment of the present invention.
Figure 7:
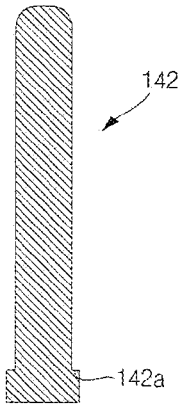
FIG. 7 is a cross-sectional view of a heat shield unit of the hairstyling brush iron according to an embodiment of the present invention.

FIG. 1 is a perspective view of a hairstyling brush iron according to an embodiment of the present invention, FIG. 2 is a cross-sectional view of the line A-A' of FIG. 1, FIG. 3 is a perspective view of an iron roll of the hairstyling brush iron according to an embodiment of the present invention, FIG. 4 is a cross-sectional view of the iron roll of the hairstyling brush iron according to an embodiment of the present invention, FIG. 5 is a cross-sectional view of a brush of the hairstyling brush iron according to an embodiment of the present invention, FIG. 6 is a cross-sectional view illustrating a heat transfer unit of the hairstyling brush iron according to an embodiment of the present invention, and FIG. 7 is a cross-sectional view illustrating a heat shield unit of the hairstyling brush iron according to an embodiment of the present invention.

Referring to FIGS. 1 to 7, the hairstyling brush iron 100 includes a handle 110, an iron roll 120, heaters 130, brushes 140, and a fixing unit 150.

The handle 110 is gripped by a user's hand when the hairstyling brush iron 100 is used. In order to apply power to the heaters 130 formed at one end of the handle 110, a power supply (not shown) is connected to the other end of the handle 110. Here, the outer portion of the handle 110 is formed of an electrical, thermal insulator for ensuring user's safety.

The handle 110 may include a switch 111 for controlling power on/off, a thermostat button 112 for adjusting the temperature of the brushes 140, and a display 113 indicating the current temperature of the brushes 140 through a light emitting diode (LED).

The iron roll 120 is coupled to an end of the handle 110. The iron roll 120 extends lengthwise from the handle 110 and is formed of a metal material. The iron roll 120 receives heat from the heaters 130 formed therein and transmits the heat to the brushes 140.

The iron roll 120 has a hole 121 lengthwise formed therein. In addition, since the heaters 130 are coupled to the hole 121, the heaters 130 are formed in a lengthwise direction of the iron roll 120, thereby uniformly applying heat to the iron roll 120.

The iron roll 120 has a substantially cylindrical shape, and includes first grooves 122 formed on its outer peripheral surface to be coupled to the brushes 140. The first grooves 122 are lengthwise formed along the lateral surface of the iron roll 120. In addition, the first grooves 122 have lower portions disposed within the iron roll 120 having larger diameters than upper portions disposed outside the iron roll 120, thereby preventing the brushes 140 coupled to the first grooves 122 from being dislodged. The first grooves 122 are radially formed along the periphery of the iron roll 120. This allows the brushes 140 coupled to the first grooves 122 to have a shape of a general roll brush.

A second groove 123 is formed at an end of the iron roll 120, and the fixing unit 150 is coupled to the second groove 123. The fixing unit 150 seals side portions of the first grooves 122, thereby fixing the brushes 140 coupled to the first grooves 122.

The heaters 130 are formed within the hole 121 of the iron roll 120. Since the heaters 130 are arranged in a lengthwise direction within the iron roll 120, they may apply a uniform amount of heat to the iron roll 120. The heaters 130 may be general heaters, for example, ceramic heaters, but not limited thereto.

The brushes 140 are formed in plurality to be coupled to the first grooves 122 of the iron roll 120. The brushes 140 are coupled to the first grooves 122 in a row. In addition, as many brushes 140 as the first grooves 122 are formed and coupled to the first grooves 122, respectively. Alternatively, fewer brushes 140 than the first grooves 122 may be formed, so that the brushes 140 may be formed only in some selected first grooves 122.

The brushes 140 receive heat from the iron roll 120 and transfer the heat to user's hair, thereby setting a hair style.

Each of the brushes 140 includes a heat transfer unit 141 coupled to each of the first grooves 122 of the iron roll 120, and a heat shield unit 142 formed within the heat transfer unit 141.

The heat transfer unit 141 is formed such that a diameter of its lower portion is greater than that of its upper portion so as to allow the lower portion to be coupled to the first grooves 122 of the iron roll 120. Since the heat transfer unit 141 receives heat from the iron roll 120 and transfers the same to the user's hair, it may be formed of a highly conductive metal. In addition, the heat transfer unit 141 has a hollow hole that vertically extends through the inside of the heat transfer unit 141. An upper portion of the heat shield unit 142 may be exposed through the hollow hole. In addition, the hollow hole of the heat transfer unit 141 may have a lower diameter greater than an upper diameter, which provides a stepped portion 141*a*. Therefore, if the heat shield unit 142 is coupled to the stepped portion 141*a*, it is possible to prevent the heat shield unit 141 from being dislodged. In addition, the heat transfer unit 141 has a lower outer peripheral surface having a predetermined thickness "d". Thus, the thickness "d" of the heat transfer unit 141 makes adjacent heat transfer units 141 spaced apart from each other.

The heat shield unit 142 is positioned in the hollow hole of the heat transfer unit 141. In addition, the heat shield unit 142 is formed such that its lower diameter is greater than its upper diameter, providing for a stepped portion 142*a*. The stepped part 142*a* of the heat shield unit 142 is coupled to the stepped portion 141*a* of the heat transfer unit 141. The thickness "d" of the heat transfer unit 141 makes adjacent heat shield units 142 spaced apart from each other. Since a height of the heat shield unit 142 is greater than that of the heat transfer unit 141, the heat shield unit 142 protrudes further than a top portion of the heat transfer unit 141. In order to suppress heat transfer of the heat shield unit 141 and the iron roll 120, the heat shield unit 142 may be formed of a plastic material having low thermal conductivity. Specifically, the heat shield unit 142 may be formed of nylon or polybutylenterephthalate (PBT) having high thermal resistance. Therefore, it is possible to prevent the heat transfer unit 141 of high temperature from contacting user's scalp when the hairstyling brush iron 100 is used by the user, while allowing the heat shield unit 142 having relatively low heat conductivity to contact the user's scalp, thereby protecting the user's scalp.

The fixing unit 150 is coupled with the second groove 123 of the iron roll 120. A diameter of the fixing unit 150 is larger than that of the iron roll 120, thereby sealing side portions of the first grooves 122. Therefore, the fixing unit 150 prevents the brushes 140 of the iron roll 120 from being dislodged from the first grooves 122.

As described above, the hairstyling brush iron 100 according to the embodiment of the present invention includes the first grooves 122 formed in a lengthwise direction on the lateral surface of the iron roll 120, and the heat transfer units 141 coupled to the first grooves 122 to make the heat transfer units 141 contact user's hair, thereby facilitating hair style setting. In addition, the hairstyling brush iron 100 according to the embodiment of the present invention includes heat shield units 142 formed within the heat transfer units 141 and protruding further than top portions of the heat transfer units 141 to allow the heat shield units 142, rather than the heat transfer units 141, to contact the user's scalp, thereby protecting the user's scalp against heat of the heat transfer units 141.

Hereinafter, a configuration of a hairstyling brush iron according to another embodiment of the present invention will be described.

Figure 8:
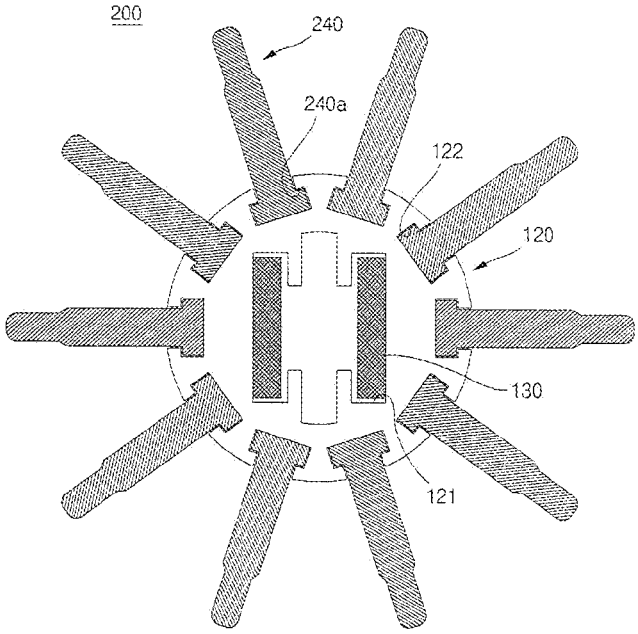
FIG. 8 is a cross-sectional view illustrating an iron roll and a brush are combined with each other in a hairstyling brush iron according to another embodiment of the present invention.
Figure 9:
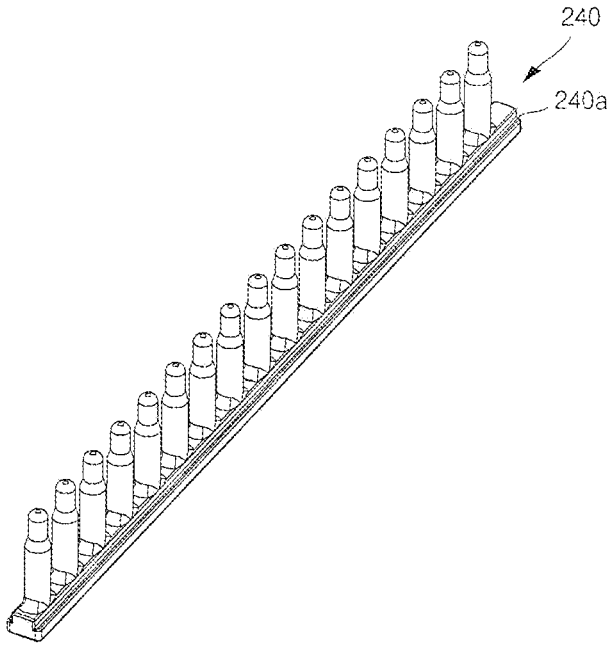
FIG. 9 is a perspective view of an iron roll of the hairstyling brush iron according to another embodiment of the present invention.
Figure 10:
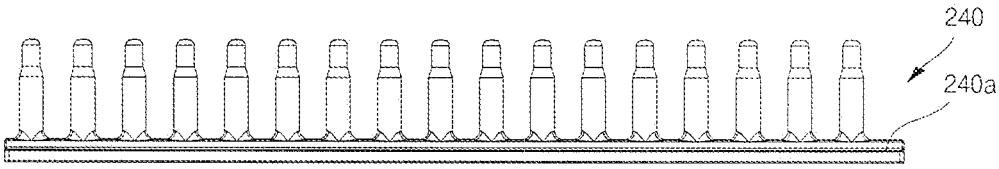
FIG. 10 is a side view of the brush of the hairstyling brush iron according to another embodiment of the present invention.
Figure 11:
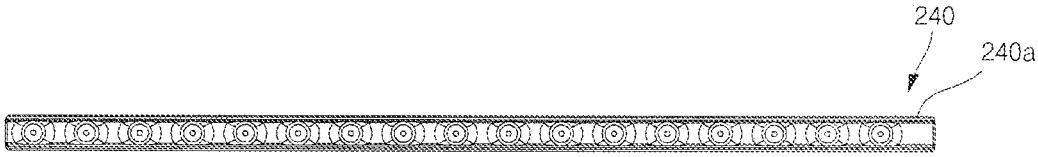
FIG. 11 is a top-plan view of the brush of the hairstyling brush iron according to another embodiment of the present invention.
Figure 12:
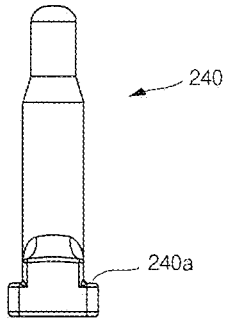
FIG. 12 is a front view of the brush of the hairstyling brush iron according to another embodiment of the present invention.

FIG. 8 is a cross-sectional view illustrating an iron roll and a brush are combined with each other in a hairstyling brush iron according to another embodiment of the present invention, FIG. 9 is a perspective view of an iron roll of the hairstyling brush iron according to another embodiment of the present invention, FIG. 10 is a side view of the brush of the hairstyling brush iron according to another embodiment of the present invention, FIG. 11 is a top-plan view of the brush of the hairstyling brush iron according to another embodiment of the present invention, and FIG. 12 is a front view of the brush of the hairstyling brush iron according to another embodiment of the present invention. The same functional components as those of the previous embodiment will be denoted by the same reference numerals, and the following description will focus on differences between the present and previous embodiments.

Referring to FIGS. 8 to 12, the hairstyling brush iron 200 according to the embodiment of the present invention includes a handle (not shown), an iron roll 120, heaters 130, brushes 240, and a fixing unit (not shown).

The brushes 240 are coupled to the iron roll 120. The brushes 240 are coupled to first grooves 122 of the iron roll 120, thereby transferring heat to user's hair. In addition, upper portions of the brushes 240 contact user's scalp. Therefore, each of the brushes 240 is formed of a plastic material having low thermal conductivity, preferably nylon or PBT having high thermal resistance, thereby protecting the user's scalp against heat.

The brushes 240 include a plurality of brushes integrally formed in an array of rows. That is, each row of the integrally formed brushes 240 is coupled to each of the first grooves 122 of the iron roll 120. In addition, each of the brushes 240 includes a stepped portion 240*a* formed at its lower portion, so that the stepped portion 240*a* is coupled to each of the first grooves 122, thereby preventing the brushes 240 from being dislodged once they are coupled to the first grooves 122. Further, the brushes 240 may be coupled to the first grooves 122 all at once from one end of the iron roll 120 where a second groove 123 is formed. Therefore, the productivity of the hairstyling brush iron 200 can be increased.

As described above, the hairstyling brush iron 200 according to the embodiment of the present invention includes the brushes 240 integrally formed for each row to allow the brushes 240 to be coupled to the first grooves 122 of the iron roll 120 all at once, thereby increasing the productivity. In addition, in the hairstyling brush iron 200 according to the embodiment of the present invention, each of the brushes 240 is formed of nylon or polybutylenterephthalate (PBT) having high thermal resistance to reduce heat transfer, thereby protecting the user's scalp against heat of high temperature.

Hereinafter, a configuration of a hairstyling brush iron according to still another embodiment of the present invention will be described.

Figure 13:
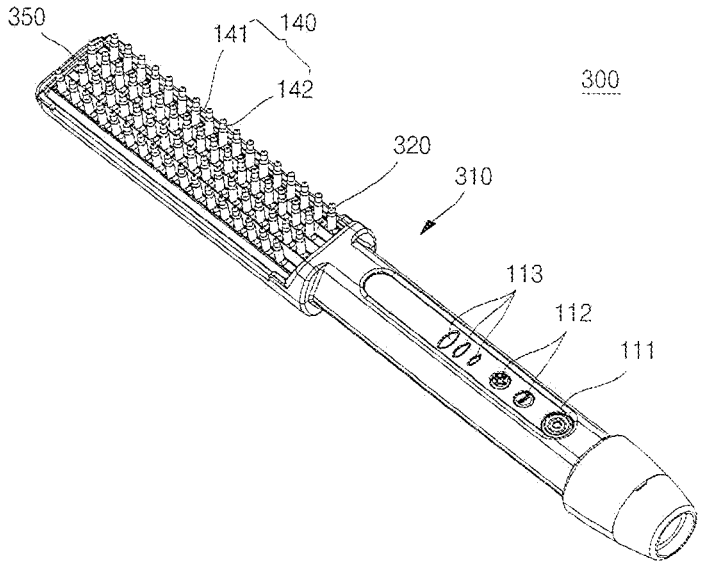
FIG. 13 is a perspective view of a hairstyling brush iron according to still another embodiment of the present invention.
Figure 14:
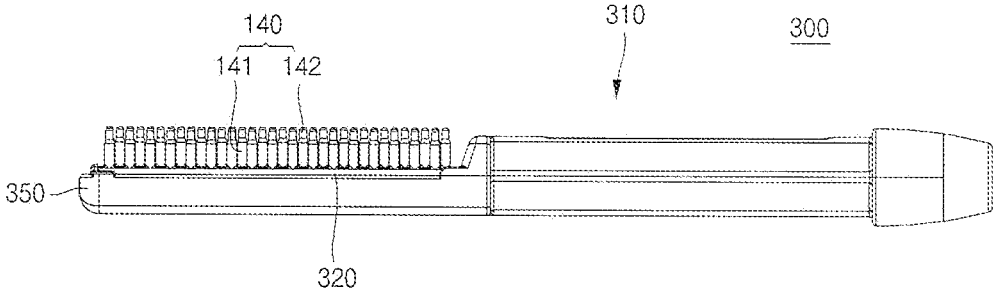
FIG. 14 is a side view illustrating brushes of the hairstyling brush iron according to still another embodiment of the present invention.
Figure 15:
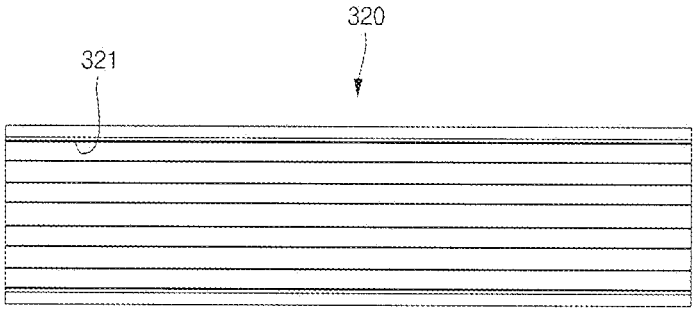
FIG. 15 is a top-plan view of an iron roll of the hairstyling brush iron according to still another embodiment of the present invention.
Figure 16:
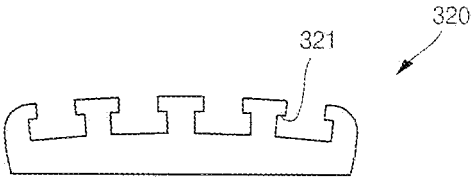
FIG. 16 is a front view of the iron roll of the hairstyling brush iron according to still another embodiment of the present invention.

FIG. 13 is a perspective view of a hairstyling brush iron according to still another embodiment of the present invention, FIG. 14 is a side view illustrating a brush of the hairstyling brush iron according to still another embodiment of the present invention, FIG. 15 is a top-plan view of an iron roll of the hairstyling brush iron according to still another embodiment of the present invention, and FIG. 16 is a front view of the iron roll of the hairstyling brush iron according to still another embodiment of the present invention.

Referring to FIGS. 13 to 16, the hairstyling brush iron 300 according to the embodiment of the present invention includes a handle 310, an iron roll 320, heaters (not shown), brushes 140, and a fixing unit 350.

The handle 310 is gripped by a user's hand and includes a power supply 111, a thermostat button 112, and a display 113. The handle 310 wraps around a surface of the iron roll 320, opposite to a surface to which the brushes 140 are coupled to thus prevent the iron roll 320 from being exposed, thereby protecting the user from the iron roll 320 of high temperature when the user uses the hairstyling brush iron 300.

The iron roll 320 is substantially plate-shaped and includes grooves 321 formed in a lengthwise direction of its one surface. Of course, the number of the grooves 321 formed in the iron roll 320 may vary according to the area of the iron roll 320. The brushes 140 are coupled to the grooves 321 and protrude toward the one surface of the iron roll 320. The iron roll 320 forms the brushes 140 in a shape of a general cushion brush.

The fixing unit 350 is coupled to an end of the iron roll 320. The fixing unit 350 seals the grooves 321 of the iron roll 320, thereby preventing the brushes 140 from being dislodged from the iron roll 320.

As described above, the hairstyling brush iron 300 according to the embodiment of the present invention includes heat transfer units 141 of the brushes 140 coupled to one surface of the plate-shaped iron roll 320, forming a cushion brush, thereby allowing the heat transfer units 141 to contact user's hair, which enables the user to easily set a hair style. In addition, the hairstyling brush iron 300 according to the embodiment of the present invention includes heat shield units 142 upwardly protruding from the brushes 140, thereby protecting the user's scalp against heat of the heat transfer units 141. In addition, although not shown, the hairstyling brush iron 300 according to the embodiment of the present invention may also include the brushes 240 used in the hairstyling brush iron 200, instead of the brushes 140. In this case, the productivity can further be increased.

Hereinafter, a configuration of a hairstyling brush iron according to still another embodiment of the present invention will be described.

Figure 17:
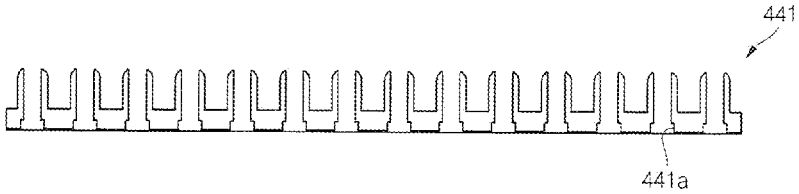
FIG. 17 is a side view illustrating heat transfer units of the hairstyling brush iron according to still another embodiment of the present invention.
Figure 18:
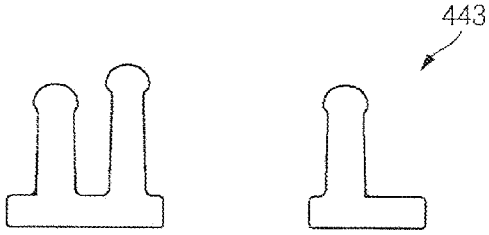
FIG. 18 is a side view illustrating protection units of the hairstyling brush iron according to still another embodiment of the present invention.
Figure 19:
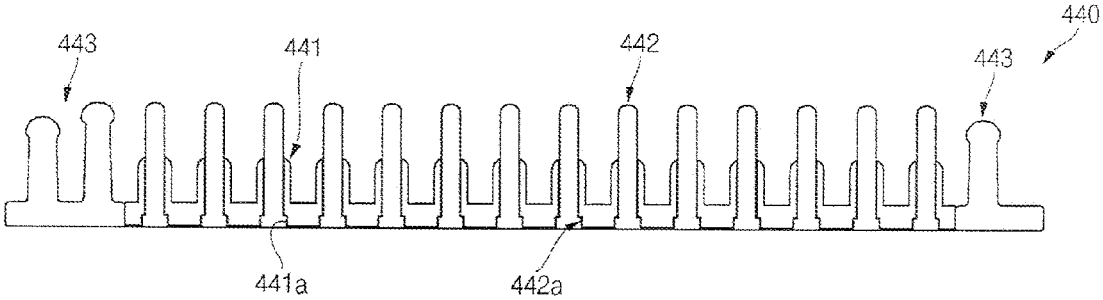
FIG. 19 is a side view illustrating a state in which the heat shield units and the protection units are combined with the heat transfer units in the hairstyling brush iron according to still another embodiment of the present invention.

FIG. 17 is a side view illustrating heat transfer units of a hairstyling brush iron according to still another embodiment of the present invention, FIG. 18 is a side view illustrating protection units of the hairstyling brush iron according to still another embodiment of the present invention, and FIG. 19 is a side view illustrating a state in which the heat shield units and the protection units are combined with the heat transfer units in the hairstyling brush iron according to still another embodiment of the present invention.

Referring to FIG. 17, each of the heat transfer units 441 used in the hairstyling brush iron according to the embodiment of the present invention is shorter than each of the heat transfer units 141 of the previous embodiments. However, the heat transfer units 441 include stepped portions 441*a* formed therein to be coupled to heat shield units to be described later.

Referring to FIG. 18, the protection units 443 used in the hairstyling brush iron according to the embodiment of the present invention are positioned at opposing ends in a lengthwise direction of the heat transfer units 441. The protection units 443 and the heat transfer units 441 are coupled to the grooves of an iron roll. The protection units 443 prevent the heat transfer units 441 from being positioned at the opposing ends, thereby protecting user's hand against heat.

Referring to FIG. 19, in the brushes 440 used in the hairstyling brush iron according to the embodiment of the present invention, heat shield units 442 are coupled to the heat transfer units 441, and the protection units 443 are positioned at opposing ends of the heat transfer units 441. Here, the heat shield units 442 include a plurality of discrete heat shield units separated from each other. The plurality of discrete heat shield units 442 are independently coupled to insides of the heat transfer units 441, respectively. Therefore, the heat shield units 442 are formed, irrespective of lengths of the heat transfer units 441 and are coupled to the heat transfer units 441 having various lengths, thereby increasing the productivity of the brushes 440.

While certain embodiments and details have been shown for purposes of illustrating the present invention, it will be apparent to those skilled in the art that various changes in the hairstyling brush iron disclosed herein may be made without departing from the scope of the invention, which is defined in the appended claims.

INDUSTRIAL APPLICABILITY

As described above, the hairstyling brush iron according to the present invention includes grooves formed in a lengthwise on the lateral surface of an iron roll and heat transfer units coupled to the grooves to allow the heat transfer units to contact user's hair, thereby facilitating hair style setting.

In addition, the hairstyling brush iron according to the present invention includes heat shield units formed in the heat transfer units and further protruding than the heat transfer units, to allow the heat shield units to contact user's scalp, thereby protecting the user's scalp from the heat transfer units of high temperature.

Further, the hairstyling brush iron according to the present invention includes brushes integrally formed by row to allow the brushes to be combined with the grooves of the iron roll all at once, thereby increasing the productivity.

What is claimed is:

1. A hairstyling brush iron comprising:

an iron roll heated up to a high temperature, the iron roll having one or more grooves formed in a lengthwise direction along an outer surface of the iron roll; and one or more brushes coupled to the iron roll, wherein each brush includes a heat transfer unit with a hollow hole formed in a vertical direction and the heat transfer unit protrudes in the direction in which a lower portion thereof is coupled to the groove of the iron roll along the lengthwise direction, and a heat shield unit coupled to the hollow hole and exposed through an upper portion of the heat transfer unit, wherein the heat transfer unit is formed such that a diameter of its lower portion is greater than a diameter of its upper portion so as to allow the lower portion to be secured within the groove.

2. The hairstyling brush iron of claim 1, wherein the heat transfer unit is formed of a metal material.

3. The hairstyling brush iron of claim 1, wherein the heat shield unit is formed of a plastic material.

4. The hairstyling brush iron of claim 1, wherein the heat shield unit has a height greater than that of the heat transfer unit so that the heat shield unit protrudes further than the upper portion of the heat transfer unit.

5. The hairstyling brush iron of claim 1, wherein each brush further comprises a protection unit formed in at least one of front and rear ends of the heat transfer unit using the same material as the heat shield unit.

6. The hairstyling brush iron of claim 1, further comprising heaters provided within the iron roll to apply heat to the iron roll.

7. The hairstyling brush iron of claim 1, wherein the iron roll is cylindrical shape and the grooves are formed in a lengthwise direction of its lateral surface.

8. The hairstyling brush iron of claim 1, wherein the iron roll is substantially plate-shaped and the grooves are formed in a lengthwise direction of its top surface.

9. A hairstyling brush iron comprising:

an iron roll heated up to a high temperature, the iron roll having a plurality of grooves formed in a lengthwise direction along an outer surface of the iron roll;

a plurality of brushes coupled to the iron roll by coupling lower portions of the brushes to the grooves of the iron roll; and a fixing unit coupled to the iron roll, wherein each of the brushes is formed of a plastic material and has a diameter of its lower portion greater than that of its upper portion so that the upper portion is exposed through an upper portion of the iron roll and the plurality of the brushes is not integrally formed but are individually separated from each other and that each brush is separately coupled to a respective one of the plurality of grooves, wherein the fixing unit seals side portions of the plurality of grooves of the iron roll, thereby preventing the plurality of brushes from being dislodged from the plurality of grooves of the iron roll.

10. The hairstyling brush iron of claim 9, wherein the iron roll is cylindrical shape and the grooves are formed in a lengthwise direction of its lateral surface.

11. The hairstyling brush iron of claim 9, wherein the iron roll is substantially plate-shaped and the grooves are formed in a lengthwise direction of its top surface.

12. The hairstyling brush iron of claim 9, further comprising heaters provided within the iron roll to apply heat to the iron roll.

13. The hairstyling brush iron of claim 9, wherein each of the brushes includes a stepped portion formed at the lower portion such that the stepped portion is coupled to each of the grooves.

14. A hairstyling brush iron comprising:

an iron roll heated up to a high temperature, the iron roll having a plurality of grooves formed in a lengthwise direction along an outer surface of the iron roll; and a plurality of brushes coupled to the iron, wherein each of the brushes includes a heat transfer unit with a hollow hole formed in a vertical direction and the heat transfer unit protrudes in the direction in which a lower portion thereof is coupled to the groove of the iron roll along the lengthwise direction, and a heat shield unit coupled to the hollow hole and exposed through an upper portion of the heat transfer unit, wherein the heat shield unit is tightly inserted into the hollow hole of the heat transfer unit, wherein the thickness of the heat transfer unit is substantially smaller than the diameter of the heat shield unit, wherein the length of the exposed portion of the heat shield unit is shorter than the length of the portion of the heat shield unit that is surrounded by the heat transfer unit, wherein the heat transfer unit is formed such that a diameter of its lower portion is greater than a diameter of its upper portion so as to allow the lower portion to be secured within the groove, wherein the hollow hole of the heat transfer unit has a lower diameter greater than an upper diameter thereby forming a stepped portion, wherein a lower diameter of the heat shield unit is greater than an upper diameter of the heat shield unit thereby forming a stepped portion, wherein stepped portion of the heat shield unit is coupled to the stepped portion of the heat transfer unit.

15. The hairstyling brush iron of claim 14, wherein each brush further comprises a protection unit formed in at least one of front and rear ends of the heat transfer unit using the same material as the heat shield unit.

16. The hairstyling brush iron of claim 14, further comprising heaters provided within the iron roll to apply heat to the iron roll.

17. The hairstyling brush iron of claim 14, wherein the iron roll is cylindrical shape and the grooves are formed in a lengthwise direction of its lateral surface.

18. The hairstyling brush iron of claim 14, wherein the iron roll is substantially plate-shaped and the grooves are formed in a lengthwise direction of its top surface.

* * * * *